United States Patent [19]

Goold

[11] 4,274,951

[45] Jun. 23, 1981

[54] ORE DRESSING PROCESS

[75] Inventor: Lionel A. Goold, Wadeville, South Africa

[73] Assignee: Trochem (PTY) Limited, Wadeville, South Africa

[21] Appl. No.: 23,447

[22] Filed: Dec. 14, 1978

[30] Foreign Application Priority Data

Dec. 14, 1977 [ZA] South Africa ..... 77/7448
Aug. 4, 1978 [ZA] South Africa ..... 78/4434

[51] Int. Cl.[3] ..... B03D 1/06
[52] U.S. Cl. ..... 209/167
[58] Field of Search ..... 209/166, 167, 5; 536/114; 210/54 R, 730

[56] References Cited

U.S. PATENT DOCUMENTS

| | | | |
|---|---|---|---|
| 2,650,917 | 9/1953 | Moe | 536/114 X |
| 2,696,912 | 12/1954 | Atwood | 209/166 |
| 3,303,184 | 2/1967 | Nordgren | 209/5 X |
| 3,346,555 | 10/1967 | Nordgren | 209/5 X |
| 3,830,736 | 8/1974 | Werdouschogg | 536/114 |
| 3,932,276 | 1/1976 | Ford | 210/75 X |

FOREIGN PATENT DOCUMENTS

| | | | |
|---|---|---|---|
| 616256 | 3/1961 | Canada | 209/166 |
| 1468014 | 1/1969 | Fed. Rep. of Germany | 536/114 |
| 1450392 | 11/1976 | United Kingdom | 209/167 |
| 276843 | 2/1969 | U.S.S.R. | 209/167 |
| 309941 | 10/1971 | U.S.S.R. | 209/167 |

*Primary Examiner*—Robert Halper
*Attorney, Agent, or Firm*—Murray and Whisenhunt

[57] ABSTRACT

A process of dressing mineral ores in order to improve the quality of the float in the flotation of certain minerals, particularly apatite ores. The process involves adding to a mineral ore pulp a gangue depressant material comprising certain guar gum ethers whereby an improved separation of calcite and other gangue minerals from the mineral values, particularly phosphate values, is obtained.

9 Claims, No Drawings

ORE DRESSING PROCESS

This invention relates to the dressing of mineral ores. More particularly the invention is concerned with improving the quality of the float in the froth flotation of certain minerals, particularly apatite ores.

Various depressants have been proposed for use in a froth flotation of apatite ores in order to derive improved separation of calcite and other gangue minerals from the phosphate values.

It is an object of this invention to provide improved depressants to be used in the froth flotation of apatite ores.

According to the invention an ore dressing process includes the steps of forming a pulp of the ore, adding to the pulp a gangue depressant material comprising a guar gum ether of the general formula R—O—G in which R is an acyclic hydrocarbon radical containing up to six carbon atoms or a cyclic hydrocarbon radical, O is oxygen and G is the guar moiety, and subjecting the pulp to froth flotation.

The guar gum ethers have been found to provide valuable depressant properties particularly in froth flotation processes conducted upon apatite ores. The guar based ethers function as selective depressants of calcite and other gangue minerals providing a float enriched with respect to phosphate values.

The preferred acyclic hydrocarbon substituent of the guar ether is a methyl or ethyl radical but ethers of other acyclic hydrocarbons containing 3 to 6 carbon atoms such as butyl and isobutyl guar ethers may be used. The preferred cyclic hydrocarbon substituent of the guar ether is a benzene radical but ethers of other cyclic hydrocarbons which may be saturated, e.g. cyclohexane may be used. There is also no reason why substituted cyclic compounds e.g. ethyl benzene would not be successful.

It will be understood that the guar ethers utilized in accordance with the invention need not be limited to those in which the hydroxyl groups of the guar molecule are substituted by the same constituent. Mixed guar ethers are possible. For example, a hydroxyl group of the guar molecule in one position may be ethyl substituted whilst one or more other hydroxyl groups of the same guar molecule may be methyl or benzene substituted.

The guar material may be substituted on any one or more of the nine hydroxyl groups on the monomeric unit of the guar gum molecule to provide a mono-, di- or poly- guar ether gangue depressant material.

In a preferred form of the invention a guar ether in which three hydroxyl groups of the guar molecule are substituted is used.

In order to illustrate the invention examples are described below:

EXAMPLE 1

Approximately 700 g. of apatite ore was formed into a pulp and conditioned at 40° C. with the addition of sodium metasilicate (approximately 2 kg./tonne); a substituted guar (0.23–0.70 kg./tonne) comprising in one instance a methyl guar ether in which three hydroxyl groups of the guar monomer were substituted, and in a second instance an ethyl guar ether in which three hydroxyl groups of the guar monomer were substituted; a fatty acid collector (approximately 0.4 Kg./tonne); and nonyl-phenyl tetraglycol ether (approximately 0.1 kg./tonne). A rougher and two cleaning stages of flotation were carried out, all stages of flotation being allowed to go to completion.

Typical assays of final concentrates were:

| | | |
|---|---|---|
| No depressant added, | Recovery 92,3% $P_2O_5$ | Grade 14,2% $P_2O_5$ |
| Methyl substituted guar ether | Recovery 71,3% $P_2O_5$ | Grade 35,2% $P_2O_5$ |
| Ethyl substituted guar | Recovery 72,9% $P_2O_5$ | Grade 37,3% $P_2O_5$ |

EXAMPLE 2

Approximately 700 g. of apatite ore was formed into a pulp and conditioned at 40° C. with the addition of sodium metasilicate (approximately 2 kg./tonne); a substituted guar (0.23–0.70 kg./tonne) comprising a benzyl guar ether in which three hydroxyl groups of the guar monomer were substituted, a fatty acid collector (approximately 0.4 kf./tonne); and nonyl-phenyl tetraglycol ether (approximately 0.1 kg./tonne). A rougher and two cleaning stages of flotation were carried out, all stages of flotation being allowed to go to completion.

Typical assays of final concentrates were:

| | | |
|---|---|---|
| No depressant added, | Recovery 92,3% $P_2O_5$ | Grade 14,2% $P_2O_5$ |
| Benzyl substituted guar ether, | Recovery 66,5% $P_2O_5$ | Grade 39,6% $P_2O_5$ |

Thus it will be seen that while a lower overall proportion of phosphate is obtained in the float a much superior grade is achieved.

It has been found that the dressing of mineral ores in accordance with the invention may be effectively utilized in a continuous flotation process. The following results illustrate the utilization of the ore dressing process when carried out in a continuous flotation pilot plant.

A sample of ethyl guar ether was tested in the pilot plant over a continuous period of five days. During this period flotation concentrates having an average value of 38.5% $P_2O_5$ with a recovery of 72.5% $P_2O_5$ was achieved.

The pilot plant of the following illustrations included a pair of parallel flotation streams each of 2.5 tonne/-hour. One of the streams was run with a standard reagent suite whilst the other was run with a suite incorporating the reagent to be tested.

One trial over a continuous four day period was carried out. In this trial the guar ether was compared with gum arabic as a standard flotation reagent. The average values obtained during this test were as follows:

| | | |
|---|---|---|
| (a) Ethyl guar ether: | Concentrate grade | 38,1% $P_2O_5$ |
| | Recovery | 66,7% $P_2O_5$ |
| (b) Gum arabic: | Concentrate grade | 34,6% $P_2O_5$ |
| | Recovery | 62,3% $P_2O_5$ |

A second trial similar to the immediately preceding one was carried out over a single day, the results obtained being as follows:

| | | |
|---|---|---|
| (a) Ethyl guar ether: | Concentrate grade | 36,4% $P_2O_5$ |
| | Recovery | 77,5% $P_2O_5$ |

-continued

| | | |
|---|---|---|
| (b) Gum arabic: | Concentrate grade | 28,3% $P_2O_5$ |
| | Recovery | 75,2% $P_2O_5$ |

In order to produce a commercially acceptable $P_2O_5$ for use particularly in the fertilizer industry, it is desirable that the concentrate grade is in excess of 36.4%. It was found that the required concentrate grade was consistently achieved using ethyl guar ether in accordance with the invention.

Also, the reagent suite necessary for flotation according to the invention was that cited in Examples 1 and 2. It was found that there was a substantial reduction in the quantities of some other reagents in the suite in order to recover the required concentrate grade. There were savings of approximately 30% of both fatty acid collector and nonylphenol tetraglycol ether. Both these reagent components are relatively expensive chemicals and a saving in the quantities required is accordingly advantageous.

The substituted guar products used in the process of the invention may be prepared, for example, by the reaction of guar gum with dialkyl sulphate in the presence of alkali metal hydroxide to yield guar alkyl ether. For the preparation of a cyclic hydrocarbon guar ether, dibenzyl sulphate may, for example, be used in the preparation instead of dialkyl sulphate.

I claim:

1. A froth flotation ore dressing process comprising forming a pulp of a phosphate-bearing ore, adding to said pulp a gangue depressant material comprising a guar gum ether of the formula $$(R—O)_nG$$

wherein R is an acyclic hydrocarbon radical containing up to six carbon atoms or a cyclic hydrocarbon radical, O is oxygen, G is the guar moiety and n is an integer of one to nine, and subjecting the pulp to froth flotation to obtain a superior grade of phosphate than obtained in the absence of said guar gum ether.

2. The ore dressing process of claim 1 in which three hydroxyl groups of the guar molecule are substituted by the radical R.

3. The ore dressing process of claim 1 in which the ore is an apatite ore.

4. The ore dressing process of claim 3 in which the gangue depressed includes calcite.

5. The ore dressing process of claim 1 in which the acyclic hydrocarbon substituent of the guar ether is an alkyl radical containing up to six carbon atoms.

6. The ore dressing process of claim 5 in which the acyclic hydrocarbon substituent of the guar ether is a methyl radical.

7. The ore dressing process of claim 5 in which the acyclic hydrocarbon substituent of the guar ether is an ethyl radical.

8. The ore dressing process of claim 1 in which the cyclic hydrocarbon substituent of the guar ether is a benzene radical.

9. A froth flotation ore dressing process comprising forming a pulp of a phosphate-bearing ore, adding to said pulp a gangue depressant material comprising a guar gum ether of the formula $$R—O—G$$

wherein R is an acyclic hydrocarbon radical containing up to 6 carbon atoms or a cyclic hydrocarbon radical, O is oxygen, and G is the remainder of the guar moiety, of which one or more hydrogen atoms of the 9 hydroxyl groups thereof have been substituted by the radical R, and thereafter subjecting the pulp to froth flotation to obtain a superior grade of phosphate than obtained in the absence of said guar gum ether.

* * * * *